US006922172B2

(12) United States Patent
Oshiyama et al.

(10) Patent No.: US 6,922,172 B2
(45) Date of Patent: Jul. 26, 2005

(54) BROAD-BAND ANTENNA FOR MOBILE COMMUNICATION

(75) Inventors: Tadashi Oshiyama, Tomioka (JP); Hirotoshi Mizuno, Tomioka (JP); Yusuke Suzuki, Tomioka (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/474,703

(22) PCT Filed: Apr. 19, 2002

(86) PCT No.: PCT/JP02/03915

§ 371 (c)(1),
(2), (4) Date: Dec. 10, 2003

(87) PCT Pub. No.: WO02/089249

PCT Pub. Date: Nov. 7, 2002

(65) Prior Publication Data

US 2004/0150563 A1 Aug. 5, 2004

(30) Foreign Application Priority Data

Apr. 23, 2001 (JP) ..... 2001-124806
Apr. 23, 2001 (JP) ..... 2001-124807
Mar. 29, 2002 (JP) ..... 2002-094910

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 848, 860

(56) References Cited

U.S. PATENT DOCUMENTS 6,448,932 B1 * 9/2002 Stoiljkovic et al. .. 343/700 MS
6,529,168 B2 * 3/2003 Mikkola et al. ..... 343/702
6,538,604 B1 * 3/2003 Isohatala et al. ..... 343/700 MS
6,573,869 B2 * 6/2003 Moore ..... 343/702
6,600,449 B2 * 7/2003 Onaka et al. ..... 343/700 MS
6,618,011 B2 * 9/2003 Eggleston et al. ... 343/700 MS
6,734,825 B1 * 5/2004 Guo et al. ..... 343/700 MS
6,734,826 B1 * 5/2004 Dai et al. ..... 343/700 MS
2004/0041733 A1 * 3/2004 Milosalvjevic ..... 343/700 MS
2004/0169606 A1 * 9/2004 Sato et al. ..... 343/702

FOREIGN PATENT DOCUMENTS

| | | | |
|---|---|---|---|
| EP | 1146590 | A2 | 10/2001 |
| JP | WO 99/03166 | A1 | 1/1999 |
| JP | 2000-68736 | A | 3/2000 |
| JP | 2001-53528 | A | 2/2001 |
| JP | 2001-85934 | A | 3/2001 |
| JP | 2002-158529 | A | 5/2002 |

* cited by examiner

*Primary Examiner*—Tan Ho
(74) *Attorney, Agent, or Firm*—Birch, Stewart, Kolasch & Birch, LLP

(57) ABSTRACT

The present invention provides a broad-band antenna for mobile communication in which a desired antenna characteristic is obtained in plural frequency bands of a portable phone or the like. A metal plate 16 having a suitable shape is disposed on an upper surface of a carrier 14 provided on a circuit board 10, and a first and a second antenna elements functioning as inverted-F antennas respectively resonant at a first frequency band and a second frequency band higher than the former are formed by electrically connecting the metal plate 16 to a grounding plate 12 and the circuit board 10 by an earthing terminal 18 and a feed terminal 20, respectively. A third antenna element 24 having a base end electrically connected to the feed terminal 20 and resonant at a third frequency band higher than the second frequency band is provided on a side surface of the carrier 14, ends of the second antenna element and the third antenna element 24 are disposed to be spaced from each other by a distance of 0.1 wavelength or more of the third frequency band, and the end of the third antenna element 24 is disposed to be spaced from the grounding plate 12 by a distance of 0.01 wavelength or more of the third frequency band. Besides, the third antenna element may be made resonant at a fourth frequency band higher than the third frequency band, and a matching circuit to perform matching for the third frequency band may be provided.

13 Claims, 15 Drawing Sheets

| Frequency MHz | MAX. Gain (dBd) | AVG. Gain (dBd) | Name of band |
|---|---|---|---|
| 880 | −0.50 | −4.10 | GSM |
| 915 | 0.18 | −3.55 | |
| 925 | 0.16 | −3.53 | |
| 960 | −0.27 | −3.89 | |
| 1710 | −0.54 | −5.54 | DCS |
| 1785 | −0.13 | −4.19 | |
| 1805 | −0.25 | −5.22 | |
| 1880 | 0.43 | −4.83 | |
| 1850 | 0.72 | −4.50 | PCS |
| 1910 | −0.12 | −5.16 | |
| 1930 | −0.52 | −5.28 | |
| 1990 | 0.49 | −4.72 | |

| Frequency MHz | MAX. Gain (dBd) | AVG. Gain (dBd) | Name of band |
|---|---|---|---|
| 880 | −0.29 | −3.71 | GSM |
| 915 | −0.56 | −4.08 | |
| 925 | −0.50 | −4.09 | |
| 960 | −0.10 | −3.82 | |
| 1710 | −0.23 | −5.38 | DCS |
| 1785 | 0.72 | −4.50 | |
| 1805 | 0.66 | −4.62 | |
| 1880 | 0.66 | −4.35 | |
| 1850 | 0.76 | −4.35 | PCS |
| 1910 | 0.69 | −4.46 | |
| 1930 | 0.85 | −4.40 | |
| 1990 | 1.05 | −4.48 | |
| 1920 | 0.83 | −4.37 | IMT−2000 |
| 1980 | 1.39 | −4.15 | |
| 2110 | −0.74 | −5.38 | |
| 2170 | −0.53 | −5.29 | |

BROAD-BAND ANTENNA FOR MOBILE COMMUNICATION

This application is the national phase under 35 U.S.C. §371 of PCT International Application No. PCT/JP02/03915 which has an International filing date of Apr. 19, 2002, which designated the United States of America.

TECHNICAL FIELD

The present invention relates to a broad-band antenna for mobile communication, which transmits and receives plural frequency bands for mobile communication such as in a portable phone.

BACKGROUND ART

As frequency bands for mobile communication of portable phones, GSM (880 to 960 MHz) and DCS (1710 to 1880 MHz) are used in Europe, AMPS (824 to 894 MHz) and PCS (1850 to 1990 MHz) are used in the United States, and PDC 800 (810 to 960 MHz) and PDC 1500 (1429 to 1501 MHz) are used in Japan. Then, as a built-in antenna of a portable phone, an antenna capable of transmitting and receiving two frequency bands respectively corresponding to areas where the equipment is used is generally used.

An example of a structure of this conventional dual band antenna for mobile communication will be described with reference to FIG. 29. FIG. 29 is an outer appearance perspective view of the example of the structure of the conventional dual band antenna for the mobile communication. In FIG. 29, a grounding plate 12 is disposed on substantially the whole surface of a circuit board 10. A carrier 14 made of a dielectric is disposed on the circuit board 10, and a metal plate 16 of a good conductor functioning as an antenna element is disposed on the upper surface of this carrier 14. A suitable slit 16*a* is provided in this metal plate 16 to make a suitable form, a suitable position of the metal plate 16 and the grounding plate 12 are electrically connected to each other by an earthing terminal 18 made of a spring connector or the like, another suitable position of the metal plate 16 and a terminal 10*a* of the circuit board 10 are electrically connected to each other by a feed terminal 20 made of a spring connector or the like, and a first and a second antenna elements functioning as inverted-F antennas respectively resonant at a first frequency band and a second frequency band are formed of the metal plate 16 provided with the slit and having the suitable shape. The first frequency band is one of the GSM, AMPS and PDC 800, and the second frequency band is one of the DCS, PCS and PDC 1500.

Here, in case the dual band antenna is incorporated in a chasis of a portable phone, a width W is restricted to about 40 mm. On the other hand, the wavelength is shortened according to the dielectric constant of the carrier 14, and as the dielectric constant of the carrier 14 becomes high, the size of the antenna becomes small, however, the gain becomes small by that. Besides, as the dielectric constant becomes low, the size of the antenna becomes large and the gain becomes large, however, it cannot be accommodated in a desired space. Then, when it is incorporated in the portable phone, it is desirable that the size of the antenna is made as large as possible within a range where it can be accommodated, and the gain becomes large in some degree. For that purpose, it is desirable that the carrier 14 is formed with a desired dielectric constant. However, the carrier 14 cannot be always formed of a suitable material from the viewpoint of manufacture or cost. Then, the carrier 14 is provided with a hollow part 22 and is formed to have a substantially C-shaped form with a top plate part 14*a* and both side parts 14*b* and 14*b*, and a desired dielectric constant in total is obtained by a dielectric constant of a material of the carrier 14 and a dielectric constant of the air in the hollow part 22.

Incidentally, although the metal plate 16 may be formed by sheet metal processing, it is a matter of course that the metal plate may be formed of a thin film of a good conductor member suitably provided on the upper surface of the carrier 14 by resin plating, hot stamp, evaporation, etching or the like.

In recent years, with comings and goings of many people between the United States and Europe, it is desired that one portable phone can be used in both the United States and Europe. Then, it is desired to realize a broad-band antenna which can transmit and receive a first frequency band intended for the GSM of Europe or the AMPS of the United States or having both the GSM and the AMPS in the band, a second frequency band intended for the DCS of Europe, and a third frequency band intended for the PCS of the United States. Besides, with the rapid development of a technique for mobile communication, IMT-2000 (1920 to 2170 MHz) higher than the conventional frequency band and used in common all over the world is proposed. Then, it is also desired to realize a broad-band antenna capable of transmitting and receiving a fourth frequency band intended for the IMT-2000.

However, if three or four antenna elements capable of being respectively resonant at the foregoing three or four frequency bands are provided on the surface of the carrier 14, the total size becomes large, and they can not be incorporated in the portable phone chassis. Besides, when they are daringly formed to have such sizes that they can be incorporated, the respective antenna elements excessively come close to each other, interference occurs among them, and a desired antenna characteristic can not be obtained.

Accordingly, the present invention has an object to provide a broad-band antenna for mobile communication which can obtain a desired antenna characteristic in plural frequency bands.

DISCLOSURE OF THE INVENTION

A broad-band antenna for mobile communication of the invention is constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a surface of the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band. Then, transmission and reception of the broad-band of the three frequency bands is enabled by the first and the second antenna elements functioning as the inverted-F antennas, and the third antenna element functioning as a monopole antenna or an inverted-F antenna. The third antenna element is disposed to be spaced from the second antenna element, so that isolation is improved, and antenna characteristics do not interfere with each other. Besides, the third antenna element is disposed to be spaced from the grounding plate, so that a coupling degree of inductive coupling and/or capacitive coupling can be made small and a width % can be obtained.

Besides, it may be constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a surface of a one side part of the carrier, and a matching circuit is connected to the feed terminal to perform matching for the third frequency band. Then, even if the third antenna element is not disposed to be spaced from the grounding plate, transmission and reception of the broad-band of the three frequency bands is enabled by providing the matching circuit.

Besides, it may be constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided on a surface of the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band. Then, transmission and reception of the broad-band of the four frequency bands is enabled.

Besides, it may be constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, part of the grounding plate facing a one side part of the carrier is removed, a third antenna element having a base end electrically connected to the feed terminal and resonant at a fourth frequency band of frequencies higher than the second frequency band is provided on a surface of the one side part of the carrier, and a matching circuit is connected to the feed terminal to perform matching for a third frequency band of frequencies intermediate between the second frequency band and the fourth frequency band. Then, the third antenna element is disposed to be spaced from the grounding plate. Then, transmission and reception of the broad-band of the four frequency bands is enabled.

Besides, it may be constructed such that a carrier made of a dielectric, provided with a hollow part and having a top plate part is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a lower surface of the top plate part of the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band. Then, when the thickness of the top plate part is suitably set, the third antenna element can be disposed to be spaced from the second antenna element by the suitable distance, and transmission and reception is enabled in the three frequency bands. Besides, the first and the second antenna elements can also be extensively disposed on the whole of the upper surface of the carrier.

Besides, it may be constructed such that a carrier made of a dielectric, provided with a hollow part and having a top plate part is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided on a lower surface of the top plate part of the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band. Then, when the thickness of the top plate part is suitably set, the third antenna element can be disposed to be spaced from the second antenna element by the suitable distance, and by providing the matching circuit for the third frequency, transmission and reception is enabled in the four frequency bands. Besides, the first and the second antenna elements can also be extensively disposed on the whole of the upper surface of the carrier.

Further, it can also be constructed such that part of the grounding plate facing a portion of the carrier where the third antenna element is disposed is removed to enlarge the distance between the end of the third antenna element and the grounding plate. Then, the distance between the third antenna element and the grounding plate becomes large, so that the coupling degree of the inductive coupling and/or capacitive coupling becomes low by that. Then, the third antenna element can be disposed at a low position, the height of the carrier can be made low by that, and it is convenient for miniaturization.

Furthermore, it can also be constructed such that the third antenna element is made to have a thin band shape, and is disposed on a side surface of the carrier so that its width direction is vertical to the grounding plate. Then, as compared with a monopole antenna formed of a linear member, its resonant band width can be made broad. Further, the width direction of the third antenna element is made vertical to the grounding plate, so that the capacity between the third antenna element and the grounding plate can be made minimum.

Further, it can also be constructed such that the third antenna element is disposed at a height intermediate between the upper surface of the carrier and the circuit board. Then, the third antenna element can be disposed to be spaced from any of the first and the second antenna elements and the grounding plate, and the third antenna element receives little interference.

Besides, it may be constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided to protrude from the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band. Then, since the third antenna element is provided to protrude from the carrier, the distance between the third antenna element and the second antenna element, and the grounding plate can be set to be large, and transmission and reception in the three frequency bands is enabled. Besides, since the third antenna element is not provided on the surface of the carrier, but is provided to protrude therefrom, an antenna element of any structure can be adopted, and the degree of freedom in design is high.

Besides, it may be constructed such that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided to protrude from the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band. Then, since the third antenna element is provided to protrude from the carrier, the distance between the third antenna element and the second antenna element, and the grounding plate can be set to be large, and by providing the matching circuit for the third frequency band, transmission and reception in the four frequency bands is enabled. Besides, since the third antenna element is not provided on the surface of the carrier but is provided to protrude therefrom, an antenna element of any structure can be adopted and the degree of freedom in design is high.

Further, it can also be constructed such that the first frequency band is set to have GSM or AMPS as an object or to have the GSM and the AMPS in a band, the second frequency band is set to have DCS as an object, and the third frequency band is set to have PCS as an object. Then, the three frequency bands used for the mobile communication can be transmitted and received.

Besides, it can also be constructed such that the first frequency band is set to have GSM or AMPS as an object or to have the GSM and the AMPS in a band, the second frequency band is set to have DCS as an object, the third frequency band is set to have PCS as an object, and the fourth frequency band is set to have IMT-2000 as an object. Then, the four frequency bands used for the mobile communication can be transmitted and received.

BEST MODE FOR CARRYING OUT THE INVENTION

Figure 1:
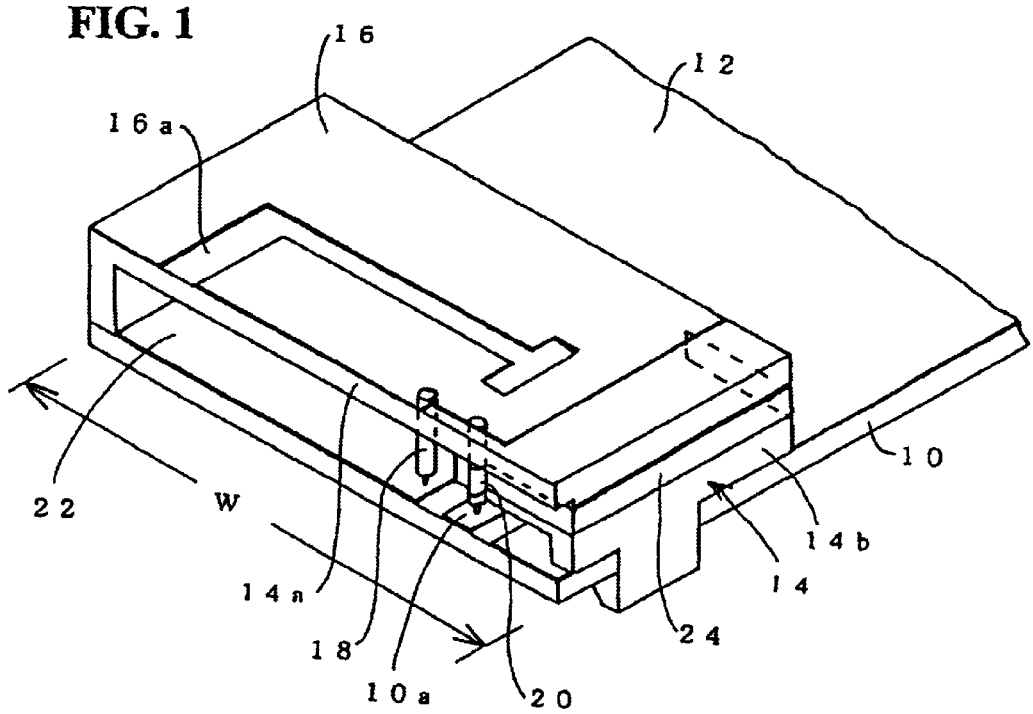
FIG. 1 is an outer appearance perspective view of a structure of a first embodiment of a broad-band antenna for mobile communication of the invention.
Figure 2:
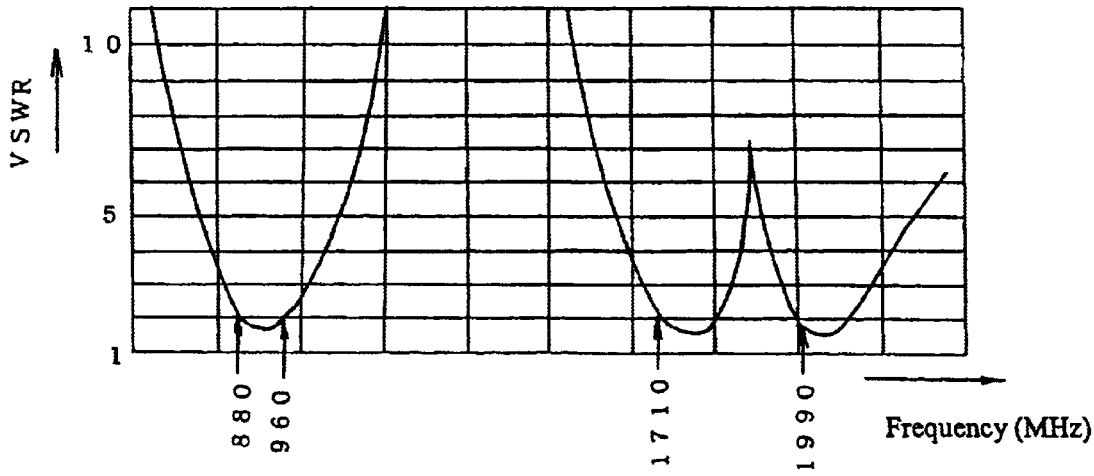
FIG. 2 is a view showing that an antiresonant point occurs when resonant frequencies of a second element and a third antenna element are close to each other.
Figure 3:
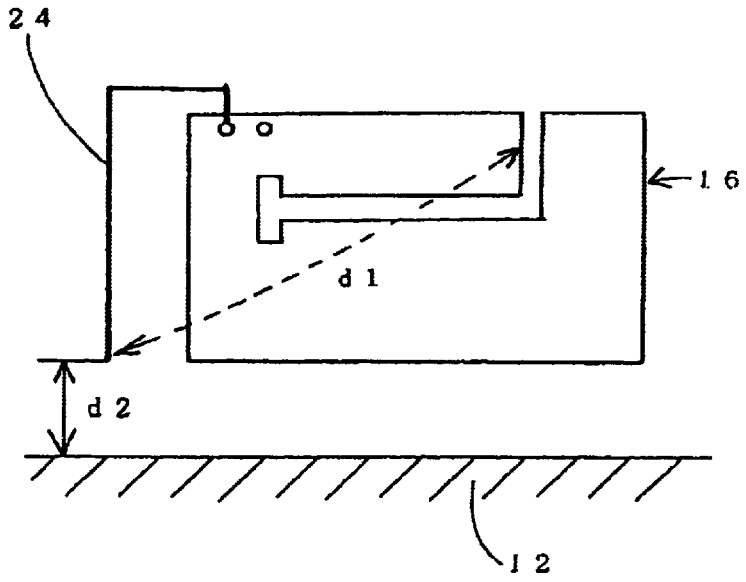
FIG. 3 is a view showing distances between respective antenna elements of the broad-band antenna for the mobile communication of the invention and a grounding plate.
Figure 4:
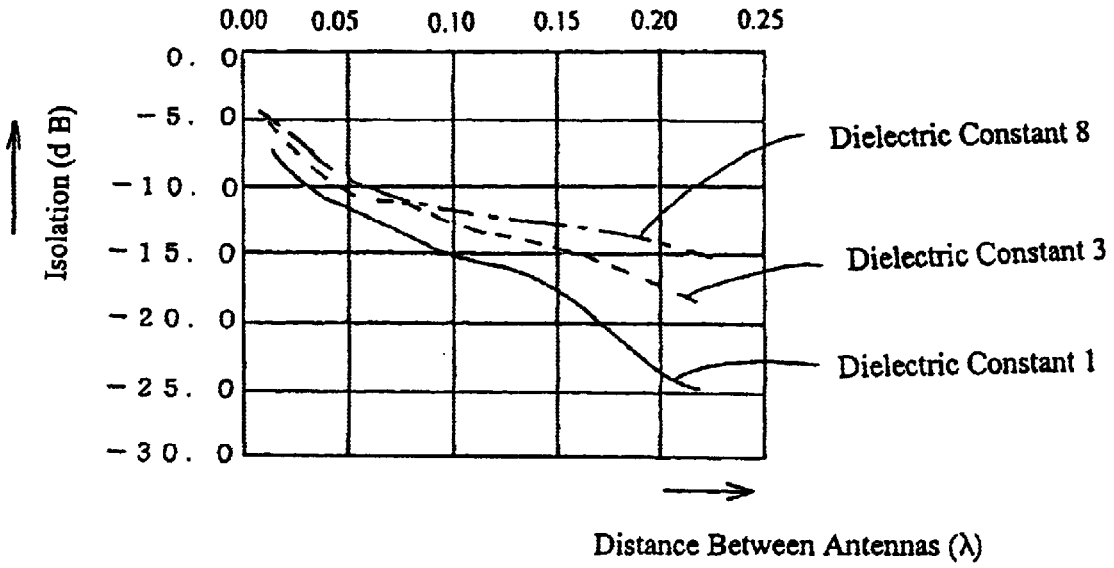
FIG. 4 is a view showing a relation of a distance between antennas of the second and the third antenna elements with respect to isolation in the first embodiment.
Figure 5:
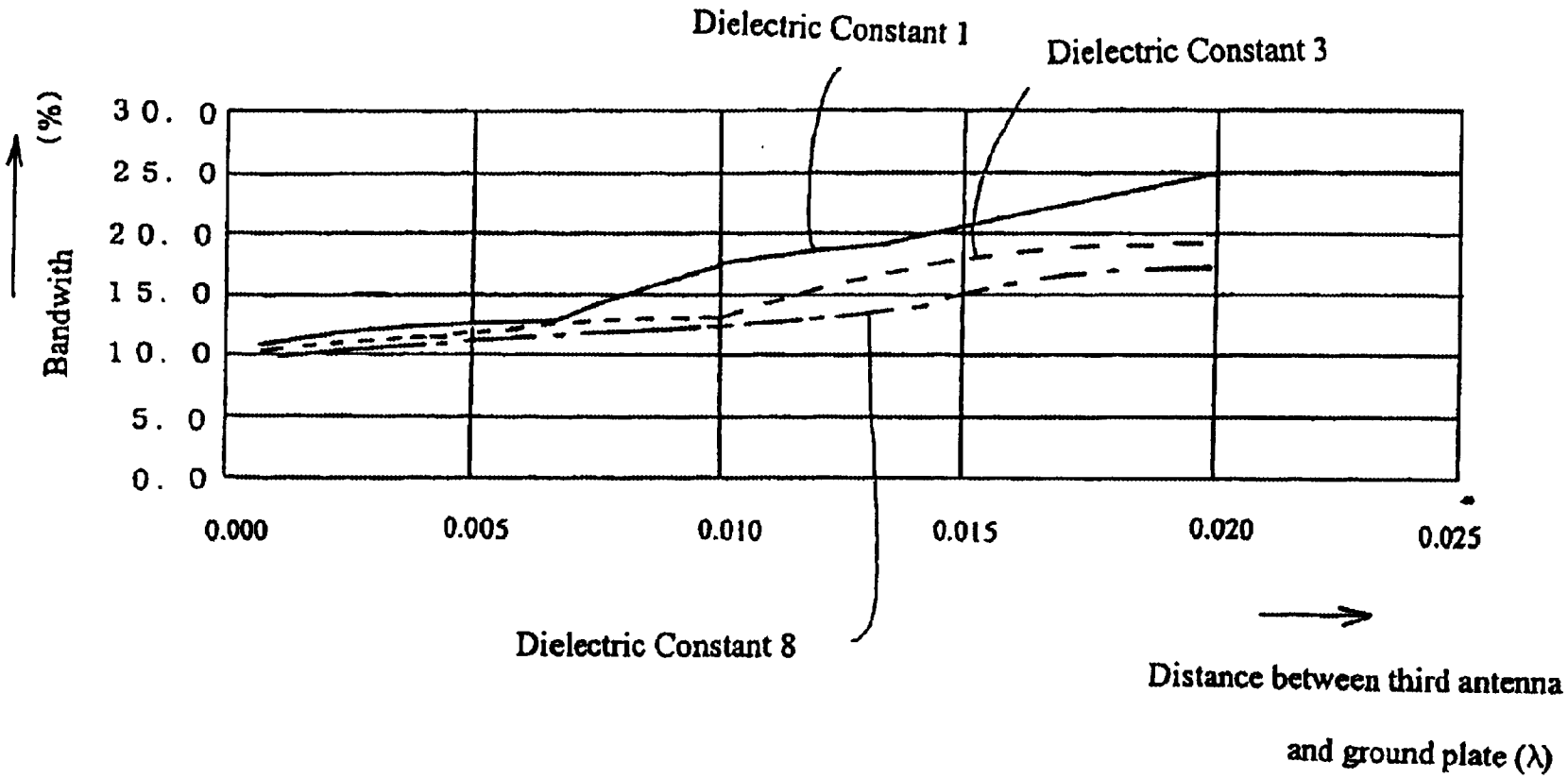
FIG. 5 is a view showing a relation of a distance between the third antenna element and the grounding plate with respect to a band width % while the second and the third antenna elements are made to have predetermined isolation in the first embodiment.
Figure 6:
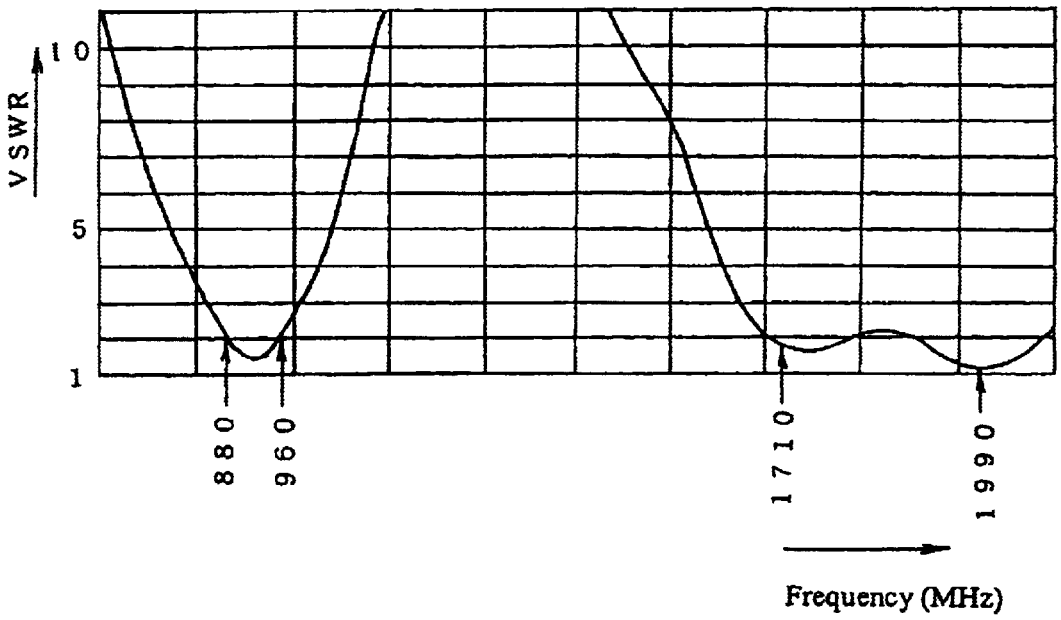
FIG. 6 is a view showing a VSWR characteristic of the first embodiment.

Hereinafter, a first embodiment of the present invention will be described with reference to FIGS. 1 to 6. FIG. 1 is an outer appearance perspective view of a structure of the first embodiment of a broad-band antenna for mobile communication of the invention. FIG. 2 is a view showing that an antiresonant point occurs when resonant frequencies of a second and a third antenna elements are close to each other. FIG. 3 is a view showing distances between respective antenna elements of the broad-band antenna for the mobile communication of the invention and a grounding plate. FIG. 4 is a view showing a relation of a distance between antennas of the second and the third antenna elements with respect to isolation in the first embodiment. FIG. 5 is a view showing a relation of a distance between the third antenna element and the grounding plate with respect to a band width % while the second and the third antenna elements are made to have predetermined isolation in the first embodiment. FIG. 6 is a view showing a VSWR characteristic of the first embodiment. In FIG. 1, the same or equivalent members as those shown in FIG. 29 are denoted by the same symbols and their duplicate explanation will be omitted.

Figure 29:
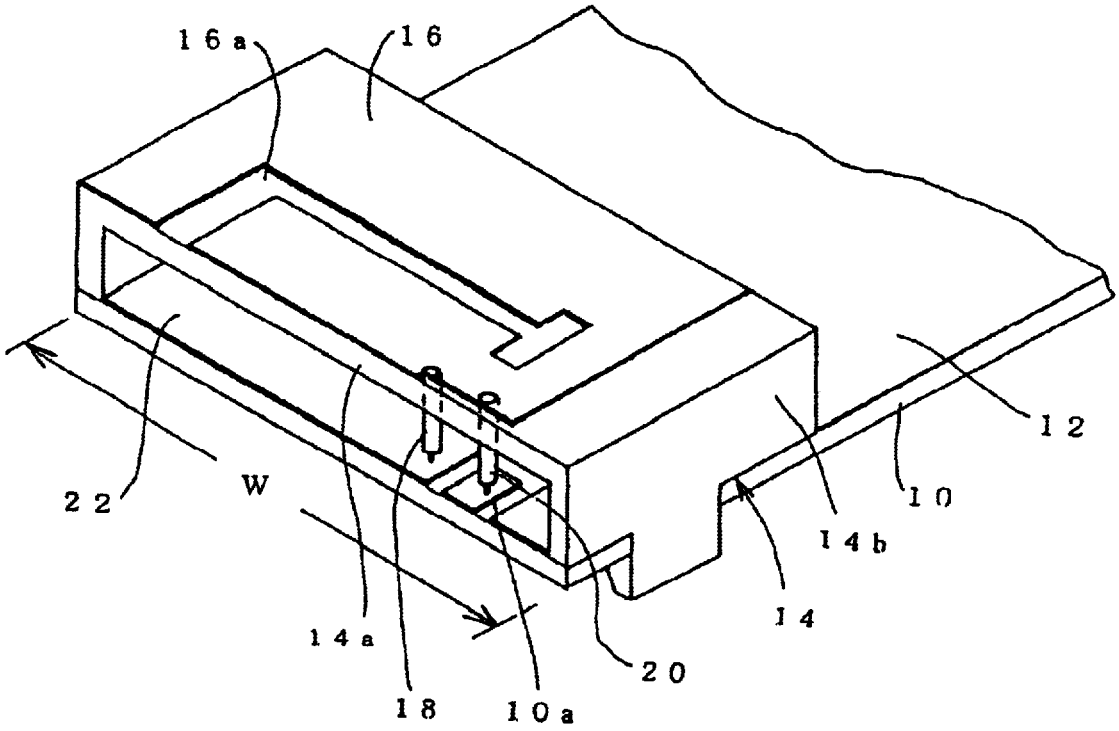
FIG. 29 is an outer appearance perspective view of a structure of a conventional dual band antenna for mobile communication.

In FIG. 1, a metal plate 16 (20×35 mm as an example) provided on an upper surface of a carrier 14 except for a one side part is provided with a suitable slit 16*a* to have a suitable shape, a suitable position of the metal plate 16 and a grounding plate 12 are electrically connected to each other through an earthing terminal 18, another suitable position of the metal plate 16 and a terminal 10*a* of a circuit board 10 is electrically connected to each other through a feed terminal 20, and a first and a second antenna element functioning as inverted-F antennas resonant at a first frequency band and a second frequency band are formed, which is similar to the conventional example shown in FIG. 29. The first frequency band of the antenna element is set to have the GSM of Europe as an object. The second frequency band of the second antenna element is set to have the DCS of Europe as an object.

Here, the metal plate 16 is not provided at the one side part of the carrier 14 similarly to the conventional example shown in FIG. 29. A third antenna element 24 having a base electrically connected to the feed terminal 20 and functioning as a thin band-like monopole antenna made of a good conductor is disposed on a surface of a side 14*b* of the carrier 14 at a side of the one side part to have an electrical length capable of being resonant (resonant at, for example, 1990 MHz) at the PCS of the United States as a third frequency band. Further, this third antenna element 24 is disposed at a intermediate height between the circuit board 10 and the upper surface of the carrier 14 and on the surface of the side 14*b* of the carrier 14.

The first embodiment of the broad-band antenna for the mobile communication of the invention having such structure functions as described below. First, the second frequency band at which the second antenna element is resonant and the third frequency band at which the third antenna element 24 is resonant are frequencies so close that part of the frequency bands overlap with each other. When the isolation of the second antenna element and the third antenna element 24 is poor, as shown in FIG. 2, an anti-resonant point occurs between the center frequencies of the second and the third frequency bands, and there is a tendency that the VSWR characteristic deteriorates very much. Besides, in the third antenna element 24, a desired antenna characteristic is hard to obtain because of inductive coupling and/or capacitive coupling with respect to the grounding plate 12.

The present inventors considered these circumstances, and experimentally obtained a distance at which the second antenna element and the third antenna element 24 had the isolation of a suitable magnitude so that the antiresonant point of a magnitude such as to actually cause disadvantage did not occur, that is, a distance d1 of FIG. 3. Further, in order that the third antenna element 24 had a desired antenna characteristic, the third antenna element 24 was spaced from the grounding plate 12 so that the inductive coupling and/or capacitive coupling became small, and a distance at which a desired band width % was obtained by the second antenna element and the third antenna element 24, that is, a distance d2 of FIG. 3 was experimentally obtained.

As shown in FIG. 4, the distance d1 between the end of the second antenna element and the end of the third antenna element is changed, and the isolation is measured while the effective dielectric constant of the carrier 14 is changed, and as a result, in order to obtain the isolation of about −15 dB, it is sufficient if the effective dielectric constant is 1 and the distance d1 between the antennas is made 0.1 λ (λ is a wavelength of the center frequency of the third frequency band at which the third antenna element 24 is resonant). As the dielectric constant becomes large, the distance d1 between the antennas must be made large in order to obtain the isolation of about −15 dB. Here, the influence degree of the isolation of about −15 dB is mutually 1/32, and it is presumed that there is little influence. Then, the effective dielectric constant of the carrier 14 was made 1, and while the isolation between the second antenna element and the third antenna element 24 was made about −15 dB, the distance d2 between the third antenna element and the grounding plate 12 was changed to measure the band width %, and as a result, as shown in FIG. 5, at the distance d2 of about 0.01 λ, as the band width % in which VSWR was 3 or less, a desired value of about 15% was obtained. Here, the band width % is indicated by a percent of a frequency width where the VSWR is 3 or less to its center frequency. Since the frequency band transmitted and received by the second antenna element and the third antenna element 24 is the DCS (1710 to 1880 MHz) and the PCS (1850 to 1990 MHz), in the frequency band of 1710 to 1990 MHz, when the center frequency is made 1850 MHz, and there is a band width % of about 15%, both the DCS and the PCS can be transmitted and received. In this way, in the VSWR characteristic of the first embodiment of the broad-band antenna for the mobile communication of the invention in which the distance d1 and the distance d2 of FIG. 3 are suitably set, as shown in FIG. 6, the VSWR is 3 or less in both the GSM (880 to 960 MHz) and the DCS and PCS (1710 to 1990 MHz), and it functions as the broad-band antenna capable of transmitting and receiving the GSM, DCS and PCS.

Incidentally, by providing the third antenna element 24 on the surface of the side 14*b* of the carrier 14 at the side of the one side part, it can be more spaced from the first and the second antenna elements than a case where it is provided on the upper surface of the carrier 14. Further, when the third antenna element 24 is formed by using a thin band-like good conductor and is disposed such that its width direction becomes vertical to the grounding plate 12, as compared with a case where a thin linear member is used, the resonant band width of the third antenna element 24 itself becomes broad, the coupling degree of the inductive coupling and/or capacitive coupling with respect to the grounding plate 12 becomes small, and an antenna characteristic as a monopole antenna can be obtained more. Incidentally, the metal plate 16 is provided on the upper surface of the carrier 14 except for the one side part, so that the distance d1 between the third antenna element 24 provided on the surface of the side 14*b* of the carrier 14 at the side of the one side part and the first and the second antenna elements formed of this metal plate 16 is made large. Then, in case the distance d1 between the third antenna element 24 and the first and the second antenna elements can be set to be large because, for example, the height of the carrier 14 is sufficient, the metal plate 16 may be provided on the whole upper surface of the carrier 14.

Figure 7:
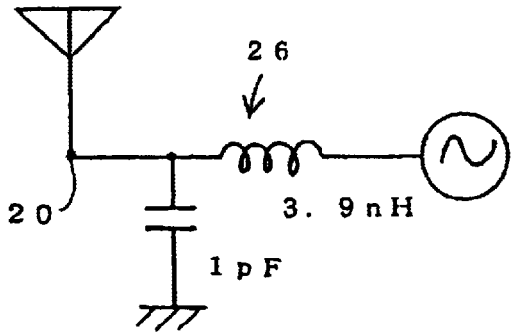
FIG. 7 is a circuit diagram of a second embodiment of the invention in which a matching circuit is provided to an antenna element having the same structure as the first embodiment of the broad-band antenna for the mobile communication.
Figure 8:
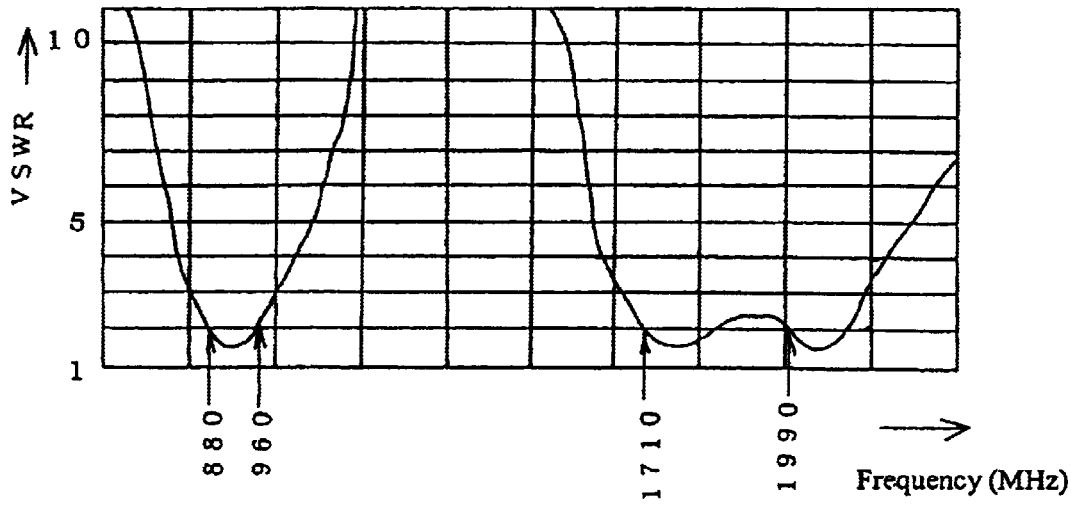
FIG. 8 is a VSWR characteristic view of the second embodiment.
Figure 9:
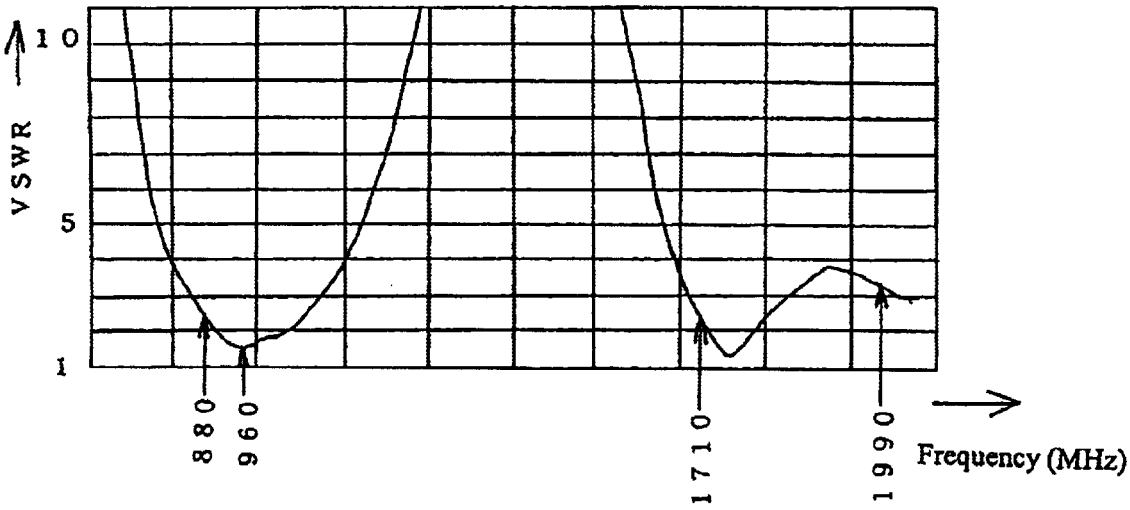
FIG. 9 is a VSWR characteristic view of a state in which the matching circuit is omitted from the second embodiment.
Figure 10:
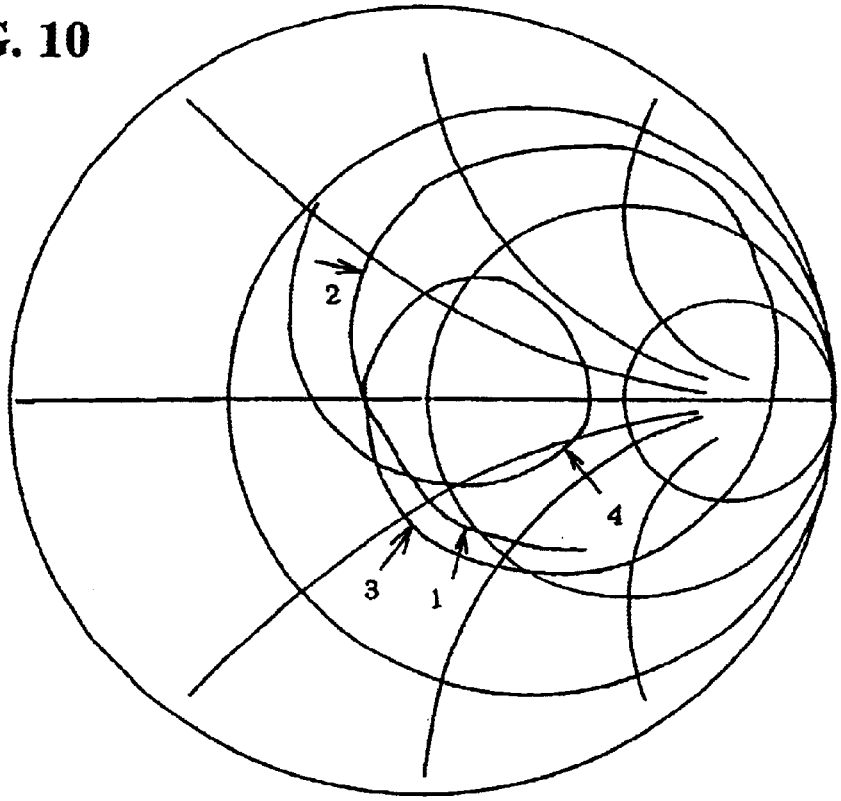
FIG. 10 is a Smith chart of the second embodiment.
Figure 11:
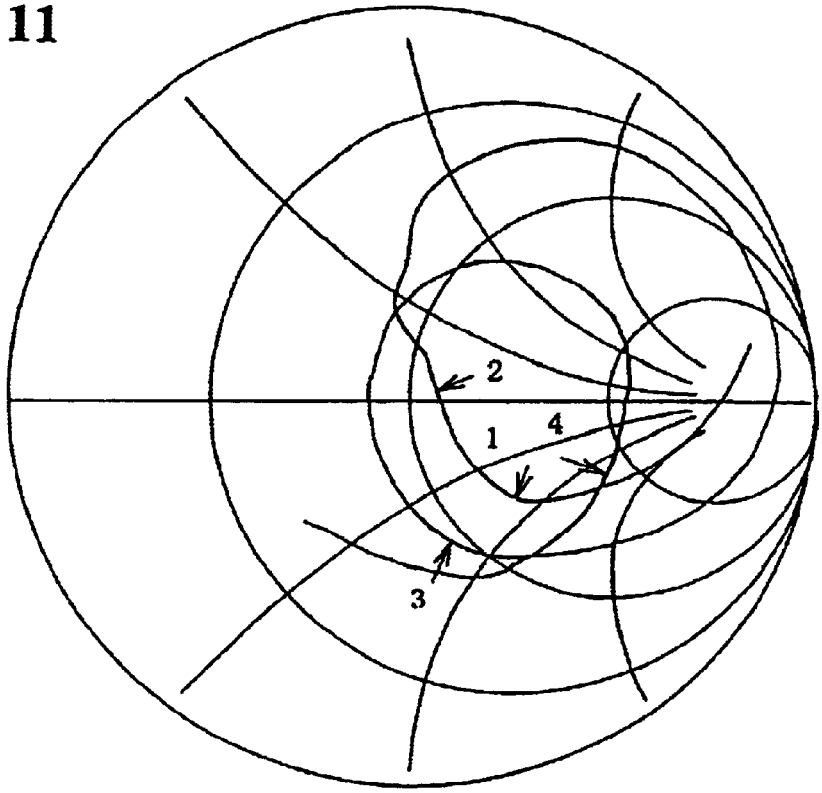
FIG. 11 is a Smith chart of a state where the matching circuit is omitted from the second embodiment.
Figures 12, 13:
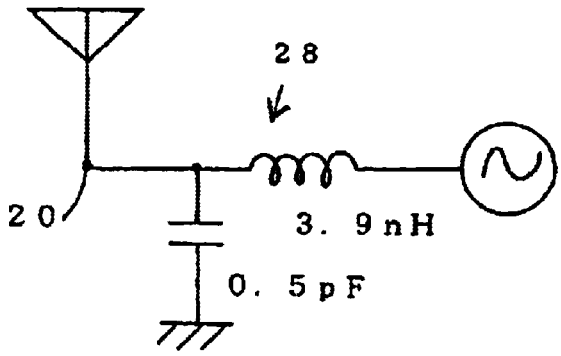
FIG. 12 is a table showing gains at respective frequencies of the second embodiment.
FIG. 13 is a circuit diagram of a third embodiment of the invention in which a third antenna element of an antenna element having the same structure as the first embodiment of the broad-band antenna for the mobile communication is set to a fourth resonant frequency and a matching circuit is provided similarly to the second embodiment.

Next, a second embodiment of the invention will be described with reference to FIGS. 7 to 12. FIG. 7 is a circuit diagram of the second embodiment of the invention in which a matching circuit is provided to an antenna element having the same structure as the first embodiment of the broad-band antenna for the mobile communication. FIG. 8 is a VSWR characteristic view of the second embodiment. FIG. 9 is a VSWR characteristic view of a state in which the matching circuit is omitted from the second embodiment. FIG. 10 is a Smith chart of the second embodiment. FIG. 11 is a Smith chart of a state where the matching circuit is omitted from the second embodiment. FIG. 12 is a table showing gains at respective frequencies of the second embodiment.

In the second embodiment, as shown in FIG. 7, in addition to an antenna element having the same structure as the broad-band antenna for the mobile communication of the first embodiment, a feed terminal 20 is electrically connected to an RF stage of a transmitter-receiver circuit of a circuit board 10 through a matching circuit 26 suitably mounted on the circuit board 10. This matching circuit 26 is constructed such that as an example, a capacitance element of 1.0 pF and an inductance element of 3.9 nH are circuit-connected into an L shape. Incidentally, in the second embodiment, a distance d2 between a third antenna element 24 and a grounding plate 12 is not sufficiently provided and is short, and the antenna element itself has such a structure that the inductive coupling and/or capacitive coupling is larger than that of the first embodiment.

In the structure as stated above, as shown in FIG. 8, with respect to the VSWR characteristic, an excellent VSWR close to "2" is obtained in any of the GSM of 880 to 960 MHz, and the DCS and the PCS of 1710 to 1990 MHz. However, with respect to the VSWR characteristic of the antenna element itself in which the matching circuit 26 is not provided, as shown in FIG. 9, although it is close to "2" or less in the GSM of 880 to 960 MHz, it is "3" or higher in the PCS or the like and deteriorates. It is presumed that this is because the third antenna element 24 is originally set to the electric length resonant at 1990 MHz of the PCS, however, the inductive coupling and/or capacitive coupling with respect to the grounding plate 12 is large, or a desired antenna characteristic is not obtained by the interference between the antenna elements. In the second embodiment, as shown in the Smith chart of FIG. 10, the antenna impedance is close to 50 Ω in the range of 880 to 960 MHz and 1710 to 1990 MHz, and indicates a value excellent in connection to a cable of 50 Ω. However, as shown in the Smith chart of FIG. 11, in the antenna element itself in which the matching circuit 26 is not provided, although the antenna impedance is close to 50 Ω at 880 to 960 MHz and 1710 MHz, the antenna impedance is rather remote from 50 Ω at the frequency close to 1990 MHz. From this, as the frequency becomes high, the effect of the matching circuit 26 becomes remarkable, and it is conceivable that the matching circuit functions to bring the antenna impedance operating as a high impedance with respect to a frequency of approximately 1990 MHz close to 50 Ω. As a result, as shown in FIG. 12, with respect to the gain of the second embodiment, a maximum gain (MAX. Gain) is −0.54 to 0.72 dBd, and an average gain (AVG. Gain) is −5.54 to −3.53 dBd. Then, an all average gain (All AVG. Gain) is −4.55 dBd, and an all maximum average gain (All MAX. AVG. Gain) is −0.01 dBd. Accordingly, the antenna gain sufficient for use in the three frequency bands of the GSM of 880 to 960 MHz, and the DCS and PCS of 1710 to 1990 MHz is obtained.

Figure 14:
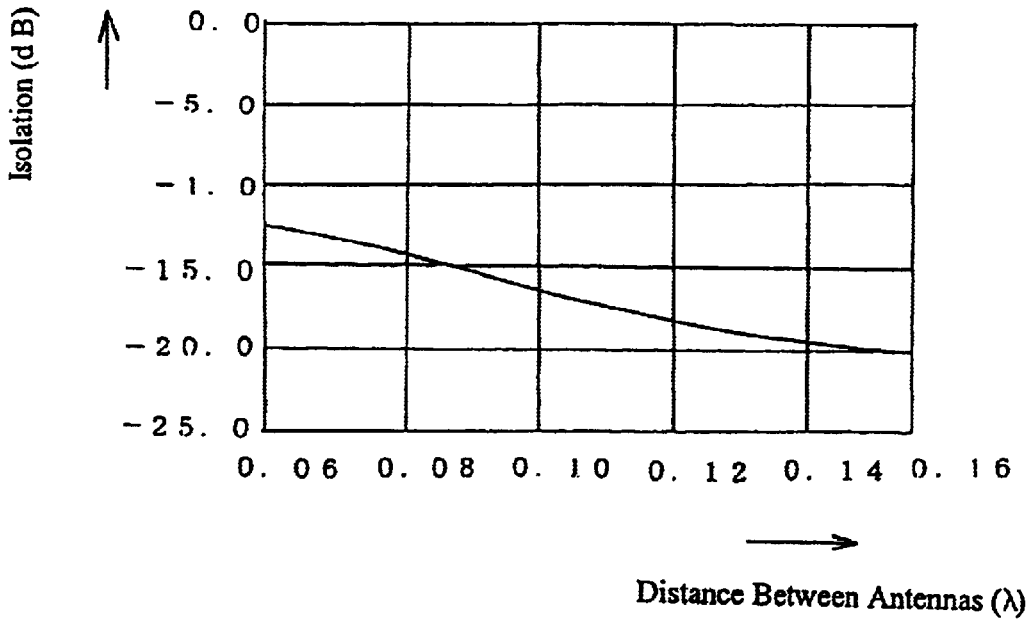
FIG. 14 is a view showing a relation of a distance between antennas of second and third antenna elements with respect to isolation in the third embodiment.
Figure 15:
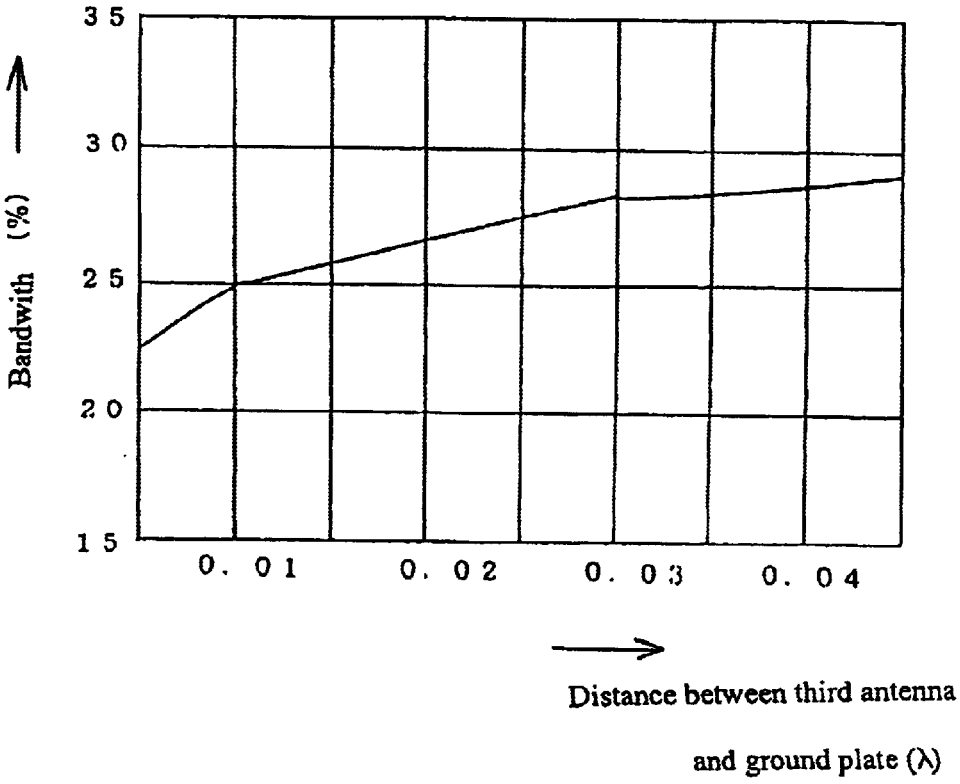
FIG. 15 is a view showing a relation of a distance between the third antenna element and a grounding plate with respect to a band width % while the second and the third antenna elements are made to have predetermined isolation in the third embodiment.
Figure 16:
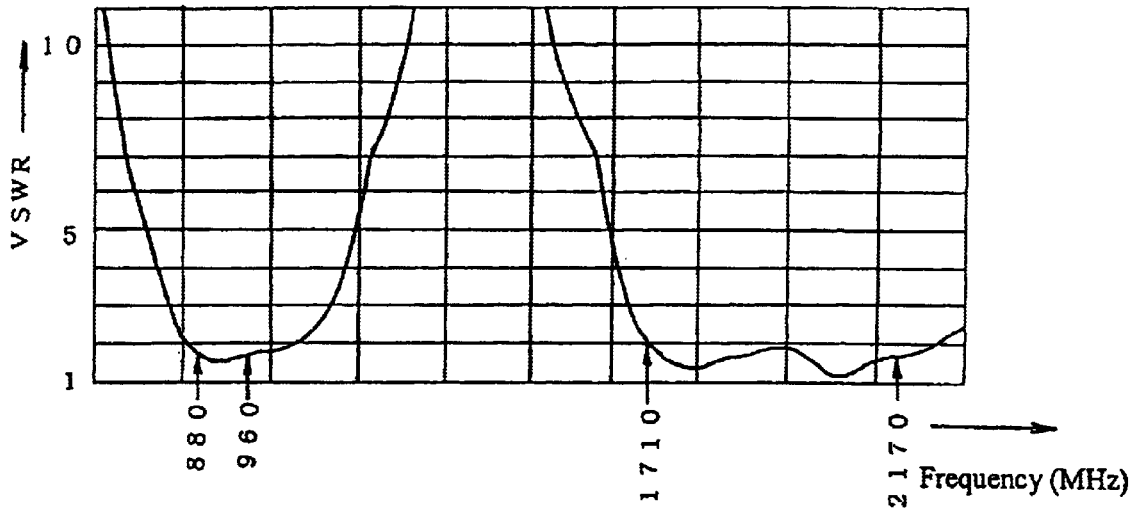
FIG. 16 is a view showing a VSWR characteristic of the third embodiment.
Figure 17:
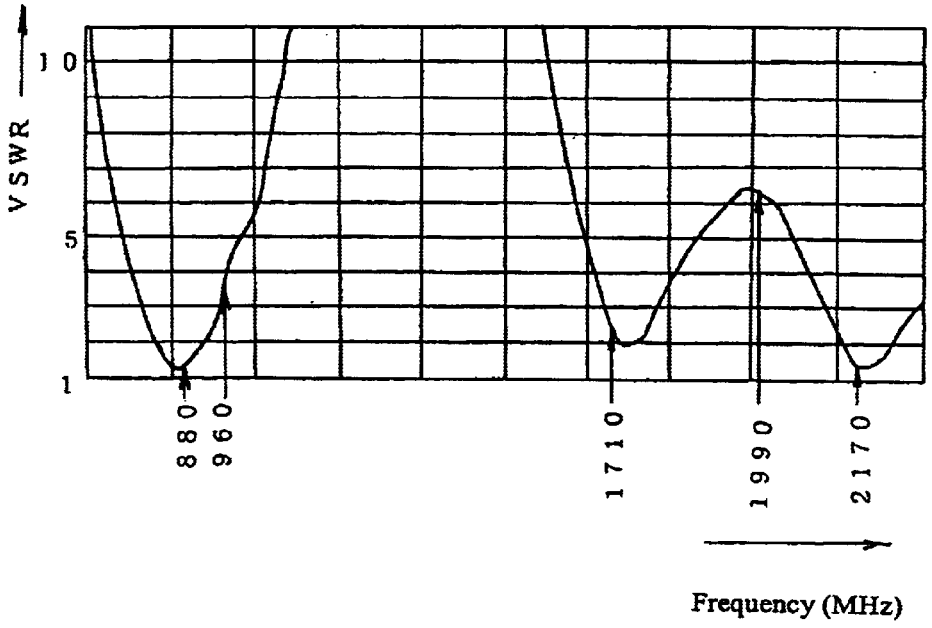
FIG. 17 is a view showing a VSWR characteristic of the third embodiment in which the matching circuit is omitted.

A third embodiment of a broad-band antenna for mobile communication of the invention will be described with reference to FIGS. 13 to 17. FIG. 13 is a circuit diagram of the third embodiment of the invention in which a third antenna element of an antenna element having the same structure as the first embodiment of the broad-band antenna for the mobile communication is set to a fourth resonant frequency and a matching circuit is provided similarly to the second embodiment. FIG. 14 is a view showing a relation of a distance between antennas of a second and a third antenna elements with respect to isolation in the third embodiment. FIG. 15 is a view showing a relation of a distance between the third antenna element and a grounding plate with respect to a band width % while the second and the third antenna elements are made to have predetermined isolation in the third embodiment. FIG. 16 is a view showing a VSWR characteristic of the third embodiment. FIG. 17 is a view showing a VSWR characteristic of the third embodiment in which the matching circuit is omitted.

The third embodiment is intended to obtain a broad-band antenna characteristic sufficient for practical use in four frequency bands of the GSM of 880 to 960 MHz, and the DCS, PCS and IMT-2000 of 1710 to 2170 MHz. Then, a third antenna element 24 of an antenna element having the same structure as the first embodiment is disposed to have an electric length so that it can resonate at the IMT-2000 (as an example, resonate at 2170 MHz) as the fourth frequency band. Then, as shown in FIG. 13, a feed terminal 20 is electrically connected to an RF stage of a transmitter-receiver circuit of a circuit board 10 through a matching circuit 28 suitably mounted on the circuit board 10. This matching circuit 28 is constructed such that as an example, a capacitance element of 0.5 pF and an inductance element of 3.9 nH are circuit-connected into an L shape. Incidentally, a constant of the matching circuit 28 is suitably set from simulation and experiments.

In the structure as stated above, the resonant frequency of the second antenna element and the resonant frequency of the third antenna element 24 are more separate from each other than those of the first embodiment, and the antiresonant point is hard to produce by that, however, since the resonant frequency of the third antenna element 24 is high, the inductive coupling and/or capacitive coupling is apt to occur, and the isolation between the second antenna element and the third antenna element 24 is apt to become poor. Then, according to experiments, as shown in FIG. 14, when the distance d1 between the end of the second antenna element and the end of the third antenna element 24 was made 0.1 λ (λ is a wavelength of a center frequency of the fourth frequency band at which the third antenna element 24 is resonant), the isolation of about −15 dB was obtained. When the band width % was measured while the isolation of about −15 dB was kept and the distance d2 between the third antenna element 24 and the grounding plate 12 was changed, as shown in FIG. 15, at the distance of 0.01 λ, as a band width % in which a VSWR was 3 or less, a desired value of about 24% was obtained. Here, since the frequency bands transmitted and received by the second antenna element and the third antenna element 24 are the DCS (1710 to 1880 MHz), the PCS (1850 to 1990 MHz), and the IMT-2000 (1920 to 2170 MHz), when the frequency width is 1710 to 2170 MHz, the center frequency thereof is made 1940 MHz, and the band width % is about 24%, the DCS, the PCS and the IMT-2000 can be transmitted and received. The VSWR characteristic of the third embodiment of the broad-band antenna for the mobile communication of the invention in which the distance d1 between the end of the second antenna element and the end of the third antenna element 24 and the distance d2 between the third antenna element 24 and the grounding plate 12 are suitably set in this way is as shown in FIG. 16. Incidentally, when the matching circuit 28 is omitted, as shown in FIG. 17, the VSWR becomes poor with respect to the third frequency band between the second frequency band and the fourth frequency band. Thus, the matching circuit 28 is provided to perform matching for the third frequency band.

Figure 18:
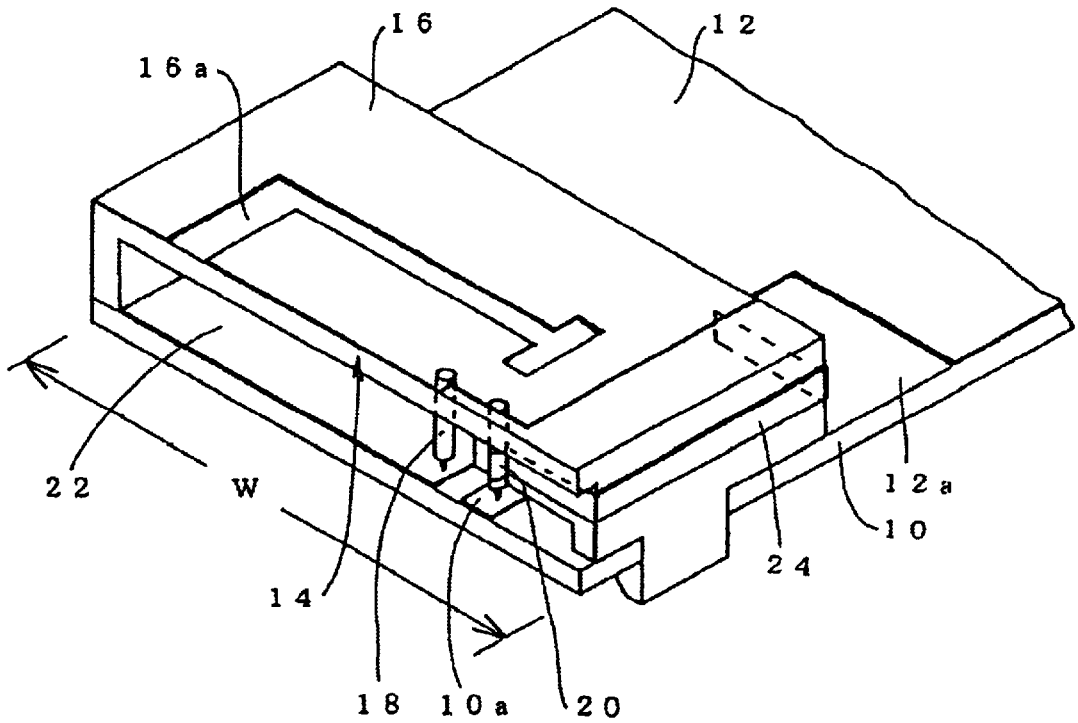
FIG. 18 is an outer appearance perspective view of a structure of a fourth embodiment of a broad-band antenna for mobile communication of the invention.

Further, a fourth embodiment of a broad-band antenna for mobile communication of the invention will be described with reference to FIG. 18. FIG. 18 is an outer appearance perspective view of a structure of the fourth embodiment of the broad-band antenna for the mobile communication of the invention. In FIG. 18, the same or equivalent members as those of FIG. 1 are denoted by the same symbols and their duplicate explanation will be omitted.

According to the fourth embodiment, as compared with the first embodiment, a removed part 12*a* where a grounding plate 12 is removed is provided at a side of a one side part where a metal plate 16 of a carrier 14 is not provided and to face a portion where a third antenna element 24 is not disposed. In the structure as stated above, a distance d2 between the third antenna element 24 and the grounding plate 12 is made large, and the coupling degree of inductive coupling and/or capacitive coupling becomes small by that. Then, the height of the carrier 14 may be low in order to obtain a band width % identical to the first embodiment, and it is convenient for miniaturization.

Figure 19:
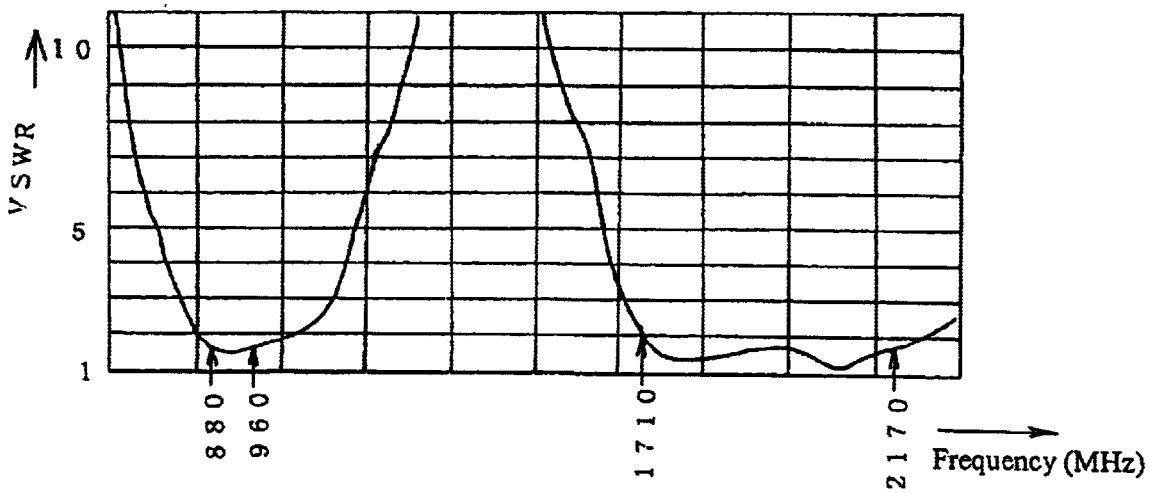
FIG. 19 is a VSWR characteristic view of a fifth embodiment.
Figure 20:
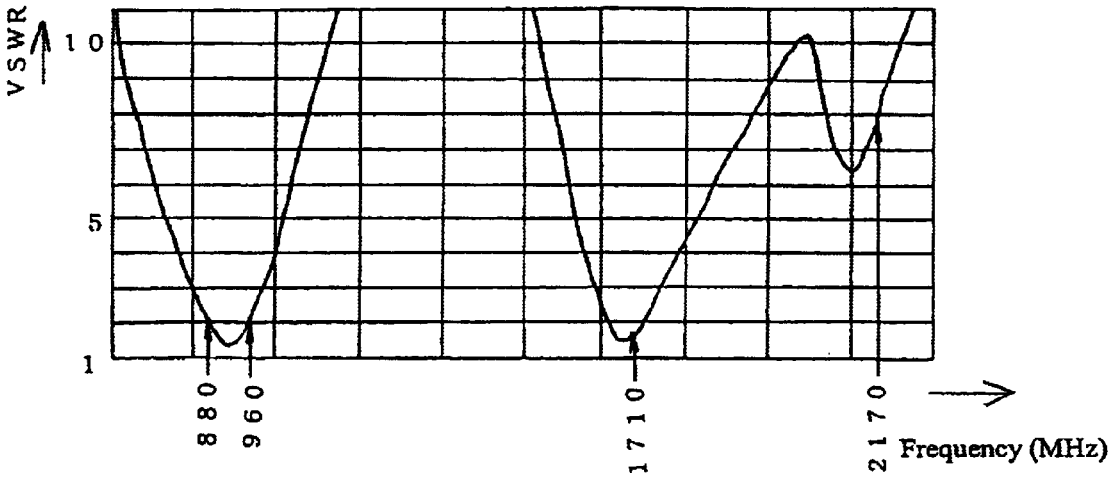
FIG. 20 is a VSWR characteristic view of a state in which a matching circuit is omitted from the fifth embodiment.
Figure 21:
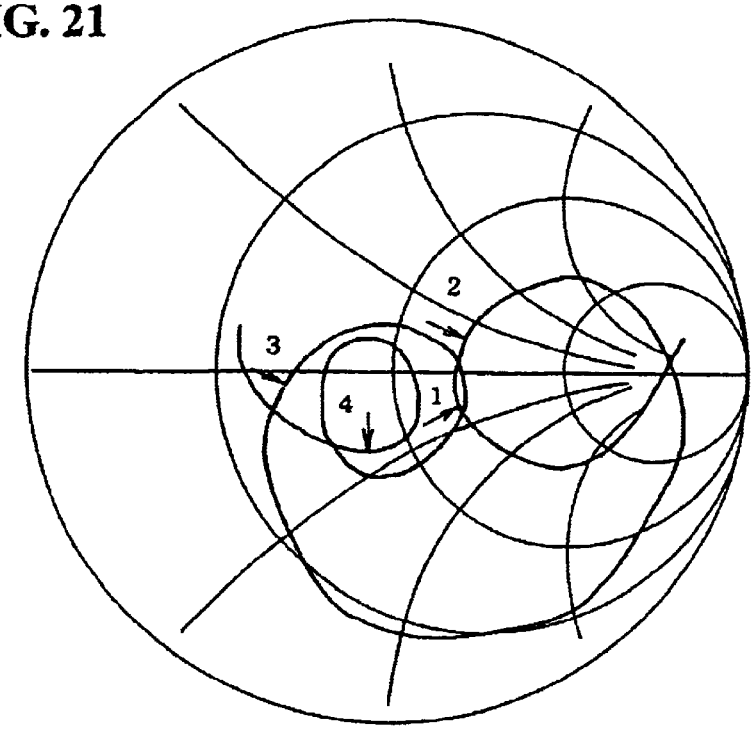
FIG. 21 is a Smith chart of the fifth embodiment.
Figures 22, 23:
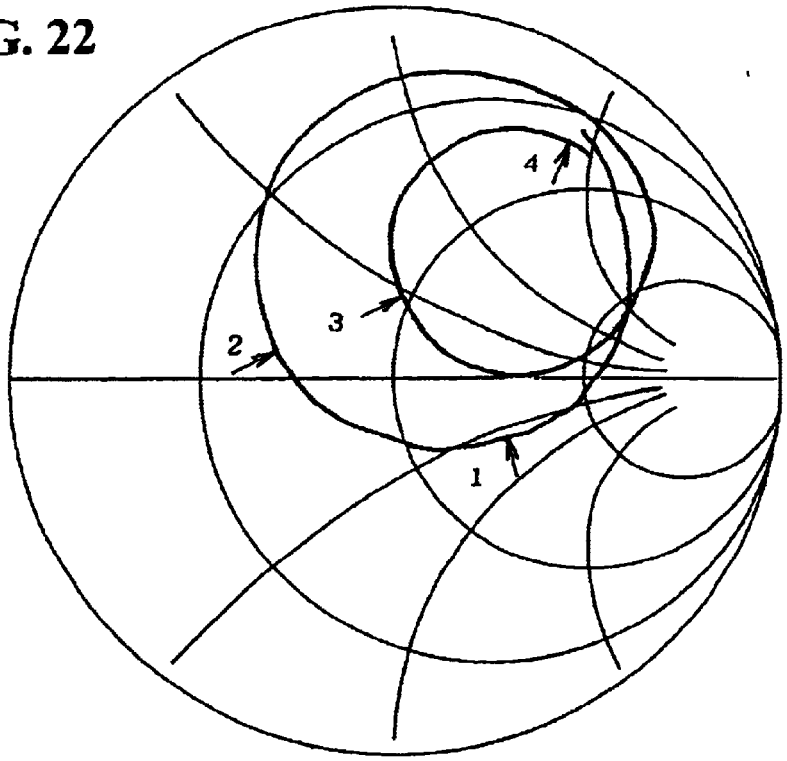
FIG. 22 is a Smith chart of a state where the matching circuit is omitted from the fifth embodiment.
FIG. 23 is a table showing gains at respective frequencies of the fifth embodiment.

Further, a fifth embodiment of the invention will be described with reference to FIGS. 19 to 23. FIG. 19 is a VSWR characteristic view of the fifth embodiment. FIG. 20 is a VSWR characteristic view of a state in which a matching circuit is omitted from the fifth embodiment. FIG. 21 is a Smith chart of the fifth embodiment. FIG. 22 is a Smith chart of a state where the matching circuit is omitted from the fifth embodiment. FIG. 23 is a table showing gains at respective frequencies of the fifth embodiment.

In the fifth embodiment, in addition to an antenna element having the same structure as the broad-band antenna for the mobile communication of the fourth embodiment, a feed terminal 20 is electrically connected to an RF stage of a transmitter-receiver circuit of a circuit board 10 through a matching circuit 28 suitably mounted on a circuit board 10 and similar to the third embodiment. This matching circuit 28 is constructed such that as an example, a capacitance element of 0.5 pF and an inductance element of 3.9 nH are circuit-connected into an L shape. Incidentally, in the fifth embodiment, with respect to the antenna element itself, a distance d2 between a third antenna element 24 and a grounding plate 12 can not be sufficiently provided and is short, and it has the structure in which the inductive coupling and/or capacitive coupling is larger than the fourth embodiment.

In the structure as stated above, with respect to the VSWR characteristic of the fifth embodiment, as shown in FIG. 19, in any of the GSM of 880 to 960 MHz, and the DCS, PCS and IMT-2000 of 1710 to 2170 MHz, an excellent VSWR of "2" or less is obtained. However, as shown in FIG. 20, with respect to the VSWR characteristic of the antenna element itself in which the matching circuit 28 is not provided, although it is "2" or less in the GSM of 880 to 960 MHz, it deteriorates to "3" or more in the PCS or the like. This would be a matter of course since the third antenna element 24 is originally set to the electric length resonant at 2170 MHz of the IMT-2000. Then, in the fifth embodiment, as shown in the Smith chart of FIG. 21, the antenna impedance is close to 50 Ω in the range of 880 to 960 MHz and 1710 to 2170 MHz, and indicates a value excellent in connection to a cable of 50 Ω. However, in the antenna element itself in which the matching circuit 28 is not provided, as shown in the Smith chart of FIG. 22, although the antenna impedance is close to 50 Ω at 880 to 960 MHz and 1710 MHz, it is indicated that the antenna impedance is rather remote from 50 Ω and becomes large at a frequency of 1710 MHz or higher. From this, as the frequency becomes high, the effect of the matching circuit 28 becomes remarkable, and it is conceivable that the matching circuit functions to bring the antenna impedance operating as a high impedance to the frequency of 1710 MHz or higher close to approximately 50 Ω. Then, with respect to gains of the fifth embodiment of the broad-band antenna for the mobile communication of the invention, as shown in FIG. 23, a maximum gain (MAX. Gain) is −0.74 to 1.39 dBd, and an average gain (AVG. Gain) is −3.71 to −5.38 dBd. An all average gain (ALL AVG. Gain) is −4.76 dBd, and an all maximum average gain (ALL MAX. AVG. Gain) is −0.33 dBd. Accordingly, the antenna gains sufficient for practical use in the four frequencies of the GSM of 880 to 960 MHz, and the DCS, PCS and IMT-2000 of 1710 to 2170 MHz are obtained.

Figure 24A:
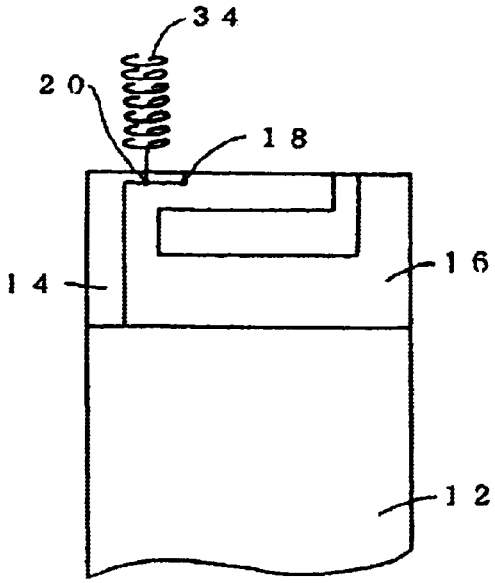
FIG. 24 is an outer appearance view of a structure of a sixth embodiment of a broad-band antenna for mobile communication, in which (a) thereof is a plan view and (b) thereof is a side view.
Figure 24B:
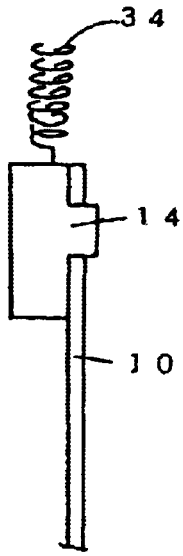
Figure 25:
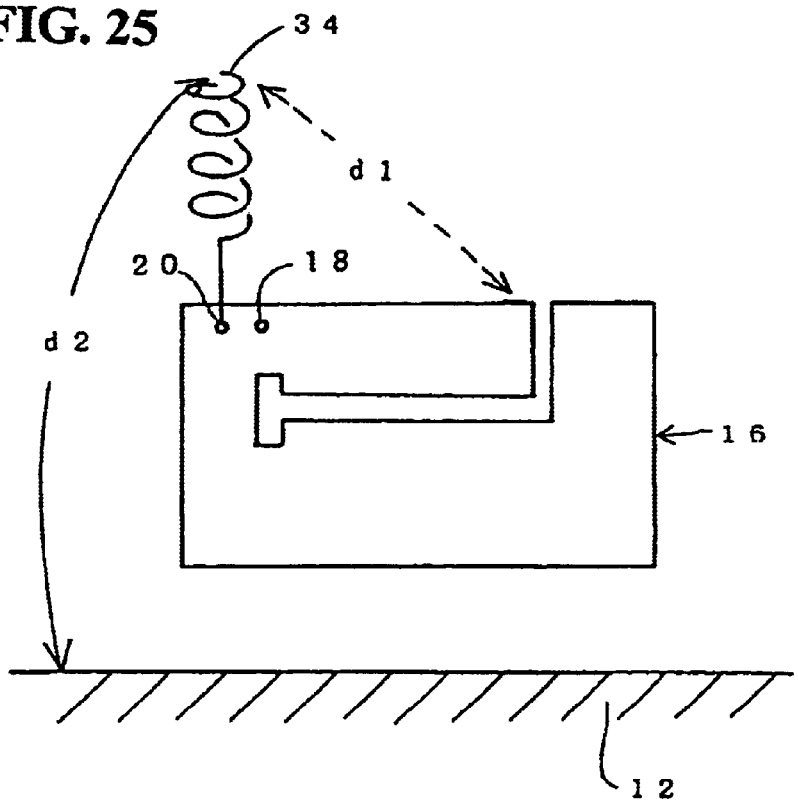
FIG. 25 is a view showing distances between respective antenna elements and a grounding plate in FIG. 24.

Besides, a sixth embodiment of a broad-band antenna for mobile communication of the invention will be described with reference to FIGS. 24 and 25. FIG. 24 is an outer appearance view of a structure of the sixth embodiment of the broad-band antenna for the mobile communication, in which (a) thereof is a plan view and (b) thereof is a side view. FIG. 25 is a view showing distances between respective antenna elements and a grounding plate in FIG. 24. In FIGS. 24 and 25, the same or equivalent members as those of FIGS. 1 and 3 are denoted by the same symbols and their duplicate explanation will be omitted.

In the sixth embodiment, a third antenna element 34 is not provided on the surface of a carrier 14, is formed of a helical coil antenna element, has a base end electrically connected to a feed terminal 20, and is provided to protrude from the carrier 14.

In the sixth embodiment of the structure as stated above, the third antenna element 34 is provided to protrude from the carrier 14, so that a distance d1 from the end of a second antenna element can be made large, and when the third antenna element 34 is made to protrude toward the side where a circuit board 10 does not exist as shown in FIG. 24, a distance d2 from a grounding plate 12 can also be made large. Then, as compared with the first embodiment, it can be used in a broader band.

Figure 26A:
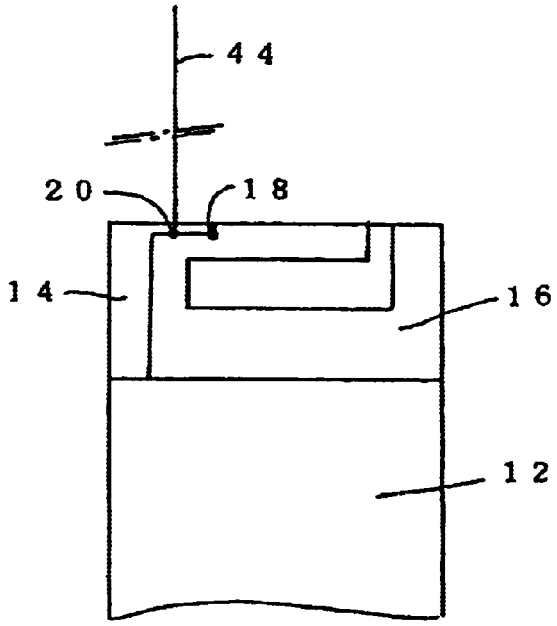
FIG. 26 is an outer appearance view of a structure of a seventh embodiment of a broad-band antenna for mobile communication, in which (a) thereof is a plan view and (b) thereof is a side view.
Figure 26B:
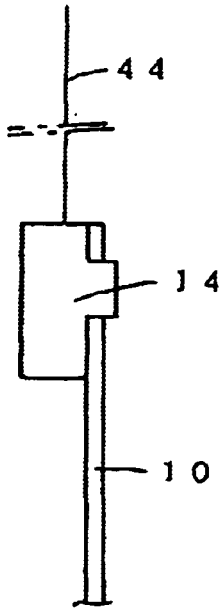

Further, a seventh embodiment of a broad-band antenna for mobile communication of the invention will be described with reference to FIG. 26. FIG. 26 is an outer appearance view of a structure of the seventh embodiment of the broad-band antenna for the mobile communication, in which (a) thereof is a plan view and (b) thereof is a side view. In FIG. 26, the same or equivalent members as those of FIG. 24 are denoted by the same symbols and their duplicate explanation will be omitted.

In the seventh embodiment, a point different from the sixth embodiment is that a third antenna element 44 is formed of a whip antenna element, has its base end electrically connected to a feed terminal 20, and is provided to protrude from a carrier 14.

Like the sixth embodiment and the seventh embodiment, when the third antenna element 34, 44 is not provided on the surface of the carrier 14, but is provided to protrude from the carrier 14, the structure of the antenna element is not limited at all, and the structure is not limited to what is described in the sixth embodiment or the seventh embodiment, and one having any structure, such as a zigzag antenna element or a meandering antenna element, can be adopted.

Figure 27:
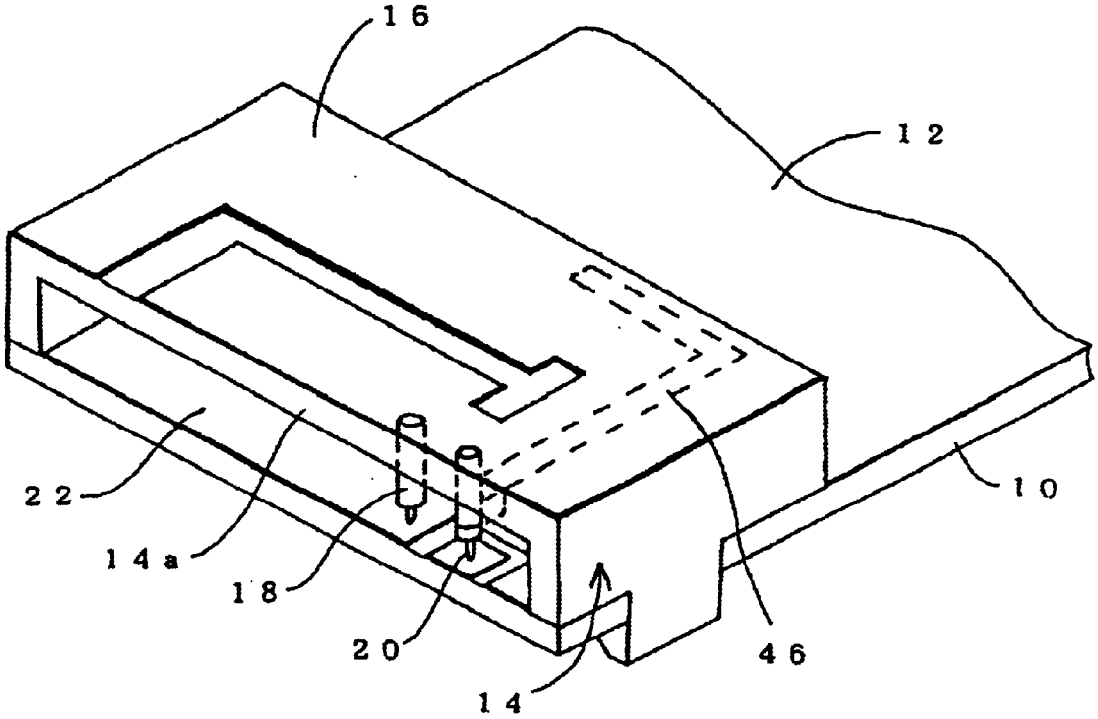
FIG. 27 is an outer appearance perspective view of a structure of an eighth embodiment of a broad-band antenna for mobile communication of the invention.
Figure 28A:
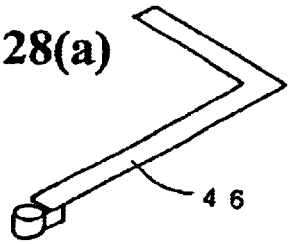
FIG. 28 is an outer appearance perspective view of a third antenna element of FIG. 27, in which (a) thereof shows a structure where a thin band-like good conductor is disposed such that its width direction is parallel to a lower surface of a top plate part, and (b) thereof shows a structure where a thin band-like good conductor is disposed such that its width direction is vertical to the lower surface of the top plate part.
Figure 28B:
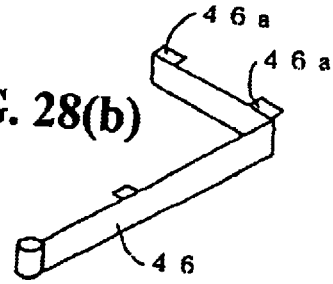

Further, an eighth embodiment of a broad-band antenna for mobile communication of the invention will be described with reference to FIGS. 27 and 28. FIG. 27 is an outer appearance perspective view of a structure of the eighth embodiment of the broad-band antenna for the mobile communication of the invention. FIG. 28 is an outer appearance perspective view of a third antenna element of FIG. 27, in which (a) thereof shows a structure where a thin band-like good conductor is disposed such that its width direction is parallel to a lower surface of a top plate part, and (b) thereof shows a structure where a thin band-like good conductor is disposed such that its width direction is vertical to the lower surface of the top plate part. In FIG. 27, the same or equivalent members as those of FIG. 1 are denoted by the same symbols and duplicate explanation will be omitted.

In FIGS. 27 and 28, the structure of the eighth embodiment is different from the first embodiment in that a third antenna element 46 is suitably disposed on the lower surface of a top plate part 14*a* of a carrier 14. The third antenna element 46 has a base end connected to a feed terminal 20 and is formed of a thin band-like good conductor. Then, as shown in FIG. 28(*a*), the third antenna element 46 is disposed such that its width direction is parallel to the lower surface of the top plate part 14*a*. Besides, as shown in FIG. 28(*b*), it may be disposed such that its width direction is vertical to the lower surface of the top plate part 14*a*. The third antenna element 46 of FIG. 28(*b*) may be suitably provided with overlap width parts 46*a*, 46*a* . . . for adhesion.

In this eighth embodiment, since the third antenna element 46 is provided at the lower surface of the top plate part 14*a*, the metal plate 16 can be disposed on the whole upper surface of the carrier 14. Then, the thickness of the top plate part 14*a* is suitably set, so that the third antenna element 46 can be disposed to be spaced from the second antenna element by a suitable distance. Besides, the third antenna element 46 is not limited to the thin band shape, but may have a terminal shape.

Incidentally, in the above embodiments, although the description has been made on the assumption that the broad-band antenna for the mobile communication of the invention is incorporated in the chassis of the portable phone, when it is used for a mobile communication equipment other than the portable phone, which does not have a strict dimensional restriction, the third antenna element 24 may be provided on the upper surface of the carrier 14 to be sufficiently spaced from the metal plate 16. Besides, it is a matter of course that the circuit structure of the matching circuits 26 and 28 is not limited to the above embodiments, and may be suitably constructed as the need arises. The first antenna element formed by providing the slit 16*a* in the metal plate 16 is not limited to what is formed to be resonant at the GSM, but may be formed to be resonant at the AMPS, and may be formed to enlarge its width and to slightly enlarge the resonant band width so that it covers both the GSM and the AMPS in the band and is resonant at them. Further, without being limited to the above embodiments, setting may be made such that the first frequency band is intended for one of the GSM, AMPS and PDC800, the second frequency band is intended for one of the DCS, PDC1500 and GPS, the third frequency band is intended for one of the PCS and PHS, and the fourth frequency band is intended for one of the IMT-2000 and Bluetooth. Besides, although the broad-band antenna for the mobile communication of the invention can transmit and receive three or four frequency bands, it is a matter of course that the broad-band antenna may be used as a built-in antenna of a portable phone for transmitting and receiving only one or two frequency bands.

Industrial Applicability

As described above, the broad-band antenna for the mobile communication of the invention can transmit and receive the broad band of three frequency bands by the first and the second antenna elements functioning as the inverted-F antennas, and the third antenna element functioning as the monopole antenna or the inverted-F antenna and resonant at the third frequency band. Besides, the third antenna element is set to be resonant at the fourth frequency band, and the matching circuit for performing matching for the third frequency band is provided, so that transmission and reception of the broad-band of the four frequency bands is enabled. Thus, the broad-band antenna for the mobile communication of the invention can transmit and receive the three or four frequency bands used for the mobile communication.

What is claimed is:

1. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a surface of the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band.

2. A broad-band antenna for mobile communication according to claim 1, characterized in that part of the grounding plate facing a portion of the carrier where the third antenna element is disposed is removed to enlarge the distance between the end of the third antenna element and the grounding plate.

3. A broad-band antenna for mobile communication according to claim 1, characterized in that the third antenna element is made to have a thin band shape, and is disposed on a side surface of the carrier so that its width direction is vertical to the grounding plate.

4. A broad-band antenna for mobile communication according to claim 1, characterized in that the third antenna element is disposed at a height intermediate between the upper surface of the carrier and the circuit board.

5. A broad-band antenna for mobile communication according to claim 1, characterized in that the first frequency band is set to have GSM or AMPS as an object or to have the GSM and the AMPS in a band, the second frequency band is set to have DCS as an object, and the third frequency band is set to have PCS as an object.

6. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a surface of a one side part of the carrier, and a matching circuit is connected to the feed terminal to perform matching for the third frequency band.

7. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided on a surface of the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band.

8. A broad-band antenna for mobile communication according to claim 7, characterized in that the first frequency band is set to have GSM or AMPS as an object or to have the GSM and the AMPS in a band, the second frequency band is set to have DCS as an object, the third frequency band is set to have PCS as an object, and the fourth frequency band is set to have IMT-2000 as an object.

9. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, part of the grounding plate facing a one side part of the carrier is removed, a third antenna element having a base end electrically connected to the feed terminal and resonant at a fourth frequency band of frequencies higher than the second frequency band is provided on a surface of the one side part of the carrier, and a matching circuit is connected to the feed terminal to perform matching for a third frequency band of frequencies intermediate between the second frequency band and the fourth frequency band.

10. A broad-band antenna for mobile communication, characterized in that a carrier made of a dielectric, provided with a hollow part and having a top plate part is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided on a lower surface of the top plate part of the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band.

11. A broad-band antenna for mobile communication, characterized in that a carrier made of a dielectric, provided with a hollow part and having a top plate part is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided on a lower surface of the top plate part of the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band.

12. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a third frequency band of frequencies higher than the second frequency band is provided to protrude from the carrier, an end of the second antenna element and an end of the third antenna element are disposed to be spaced from each other by a distance of 0.1 wavelength or more of the third frequency band, and the end of the third antenna element is disposed to be spaced from the grounding plate by a distance of 0.01 wavelength or more of the third frequency band.

13. A broad-band antenna for mobile communication, characterized in that a carrier made of a dielectric is disposed on a circuit board provided with a grounding plate on substantially a whole surface, a metal plate having a suitable shape is provided on an upper surface of the carrier, a first and a second antenna elements functioning as inverted-F antennas respectively resonant at a first frequency band and a second frequency band higher than the former are formed by providing an earthing terminal for electrically connecting the metal plate to the grounding plate and a feed terminal for electrically connecting the metal plate to the circuit board, a third antenna element having a base end electrically connected to the feed terminal and resonant at a fourth frequency band of frequencies higher than the second frequency band is provided to protrude from the carrier, an end of the second antenna element and an end of the third antenna element are disposed to be spaced from each other by a distance of 0.1 wavelength or more of the fourth frequency band, the end of the third antenna element is disposed to be spaced from the grounding plate by a distance of 0.01 wavelength or more of the fourth frequency band, and a matching circuit is connected to the feed terminal to perform matching for the third frequency band of frequencies intermediate between the second frequency band and the fourth frequency band.

* * * * *